United States Patent [19]

Kvapil et al.

[11] 4,153,299

[45] May 8, 1979

[54] COMBUSTION AIR SUPPLY TO IN-SITU RETORTS

[75] Inventors: Rudolph Kvapil, Denver; K. Malcolm Clews, Littleton, both of Colo.

[73] Assignee: Golder Associates, Inc., Kirkland, Wash.

[21] Appl. No.: 908,796

[22] Filed: May 23, 1978

[51] Int. Cl.[2] ..... E21C 41/10

[52] U.S. Cl. ..... 299/2; 299/19

[58] Field of Search ..... 299/2, 19; 166/256, 166/259, 261

[56] References Cited

U.S. PATENT DOCUMENTS

| | | | |
|---|---|---|---|
| 3,765,722 | 10/1973 | Crumb | 299/2 |
| 4,072,350 | 2/1978 | Bartel et al. | 299/2 |

FOREIGN PATENT DOCUMENTS

| | | | |
|---|---|---|---|
| 906938 | 2/1946 | France | 299/2 |

*Primary Examiner*—Ernest R. Purser

[57] ABSTRACT

An underground deposit of a carbonaceous material is retorted in an array of in-situ retorts arranged in a plurality of parallel rows. Each row of retorts is separated from adjacent rows by a pillar that extends unbroken for the length of the row. An apex drift extends longitudinally of each row and forms the crown of the retorts in that row. Combustion air for the retorting of the deposit in rubblized retorts in one row is supplied through the apex drift of an adjacent row. Delivery of combustion air into the crown of a retort for the retorting of the rubblized oil shale is through cross drifts from the apex drift of the adjacent row of retorts. Following combustion of the deposit in retorts in the first row, retorts are constructed and rubblized in a second row with the apex drift through which air had previously been supplied forming the crown of the retorts in the second row. Air for retorting deposit in the second row of retorts is delivered through a third apex drift.

19 Claims, 5 Drawing Figures

COMBUSTION AIR SUPPLY TO IN-SITU RETORTS

BACKGROUND OF THE INVENTION

1. Field of the Invention

This invention relates to the recovery of fluid fuels from subsurface deposits of carbonaceous materials, and more particularly to a method and structure for delivering combustion air into the upper end of a rubblized retort for the in-situ retorting of oil shale.

2. Description of the Prior Art

Immense potential sources of carbon-containing compounds suitable as fluid fuels exist in subsurface carbonaceous deposits of oil shale, coal, and heavy, highly viscous petroleum oils. The highly viscous petroleum oil deposits are frequently referred to as tar sands. Because the carbonaceous material in the deposits is either solid as in oil shale and coal or highly viscous as in tar sands, treatment of the carbonaceous deposit to make the carbon-containing compounds fluid is necessary to deliver them from the deposit to the surface. A method of treatment that has been used is to heat the deposit to a temperature at which fluid carbon-containing compounds are formed or the viscosity of heavy oils is drastically reduced. One method of heating the deposit is by in-situ combustion in which a portion of the carboniferous material in the deposit is burned in place by igniting the deposit and injecting air into the deposit to heat oil shale or tar sands to a temperature at which oils of low viscosity are produced or to produce combustible gaseous products from coal.

The very low permeability of oil shale makes it necessary to rubblize the shale to form an in-situ retort through which fluids for heating the shale to a temperature high enough to convert the kerogen to shale oil can be circulated. While sometimes coal and tar sands may be sufficiently permeable for an in-situ combustion process, rubblization of those deposits can be advantageous in reducing channeling through the deposits. One of the methods of forming an in-situ retort is described in U.S. Pat. No. 1,919,636 of Karrick. In the process described in that patent, a vertical central shaft is driven through the oil shale to provide the desired void space necessary for permeability and the oil shale is blasted from the walls of the shaft to fill the shaft with broken oil shale. Other mining procedures for forming a rubblized in-situ retort are described in U.S. Pat. No. 2,481,051 of Uren, U.S. Pat. No. 3,001,776 of Van Poollen and U.S. Pat. No. 3,661,423 of Garrett. Those patents suggest using various mining techniques such as sublevel stoping, sublevel caving, block caving and shrinkage stoping to form an in-situ retort having 5 to 40 percent void space.

Combustion air for the burning of a portion of the shale to liberate heat and thereby form hot combustion gases that are passed through the rubblized shale to produce shale oil is supplied in the process of Karrick through pipes extending upwardly through a retort under construction, across one retort in which combustion is occurring, and into a second retort to discharge air and fuel into the upper ends of the retorts. The pipes are exposed to temperatures resulting from combustion in the retort high enough to seriously weaken the pipes and cause their collapse. Moreover, there will be movement of the rubblized shale in the retort during the construction which can break or collapse pipes. As a practical matter, the very large size of retorts required for economic operations requires combustion air supply passages so large that pipes such as disclosed by Karrick are not feasible.

It is suggested in the Van Poollen patent that combustion air for the retorting of the shale oil be supplied through shafts drilled from the ground surface through the overburden into the upper end of the retort. Some subsidence above the retort resulting from the rubblization of shale in the retort and the subsequent weakening of rock by the high temperatures that occur during the retorting can be expected. The possibility of such subsidence raises a danger of losing the air shaft in the method described in the Van Poollen patent. Another problem with the method described in the Van Poollen patent is that the shale deposits in the Western United States are generally in mountainous regions and the number of acceptable drilling rig sites on the ground surface is limited. Directional drilling of air shafts from the ground surface with sufficient accuracy to open into the in-situ retort at the desired location would be an expensive and time-consuming operation. Subsidence of the overburden would also cause a problem in the method of Van Poollen. Rupture of pipes extending from a central compression unit to the upper end of a shaft for the combustion air injection could easily occur as a result of subsidence of the structure above the retort.

SUMMARY OF THE INVENTION

This invention resides in a system for supplying combustion air to in-situ retorts in underground carbonaceous deposits. Parallel apex drifts are driven from an air supply tunnel. Each of the apex drifts is positioned to form the crown of each of the retorts in a row of retorts separated from an adjacent row by a substantially unbroken pillar of the carbonaceous deposit. Air for the combustion of carbonaceous material in rubblized retorts in one row is supplied to those retorts through cross drifts from the apex drift of those rubblized retorts to the apex drift for an adjacent row whereby the drifts through which combustion air is delivered into a retort are through rock which is not threatened by failure of rock above completed retorts.

PREFERRED EMBODIMENT OF INVENTION

Figure 1:
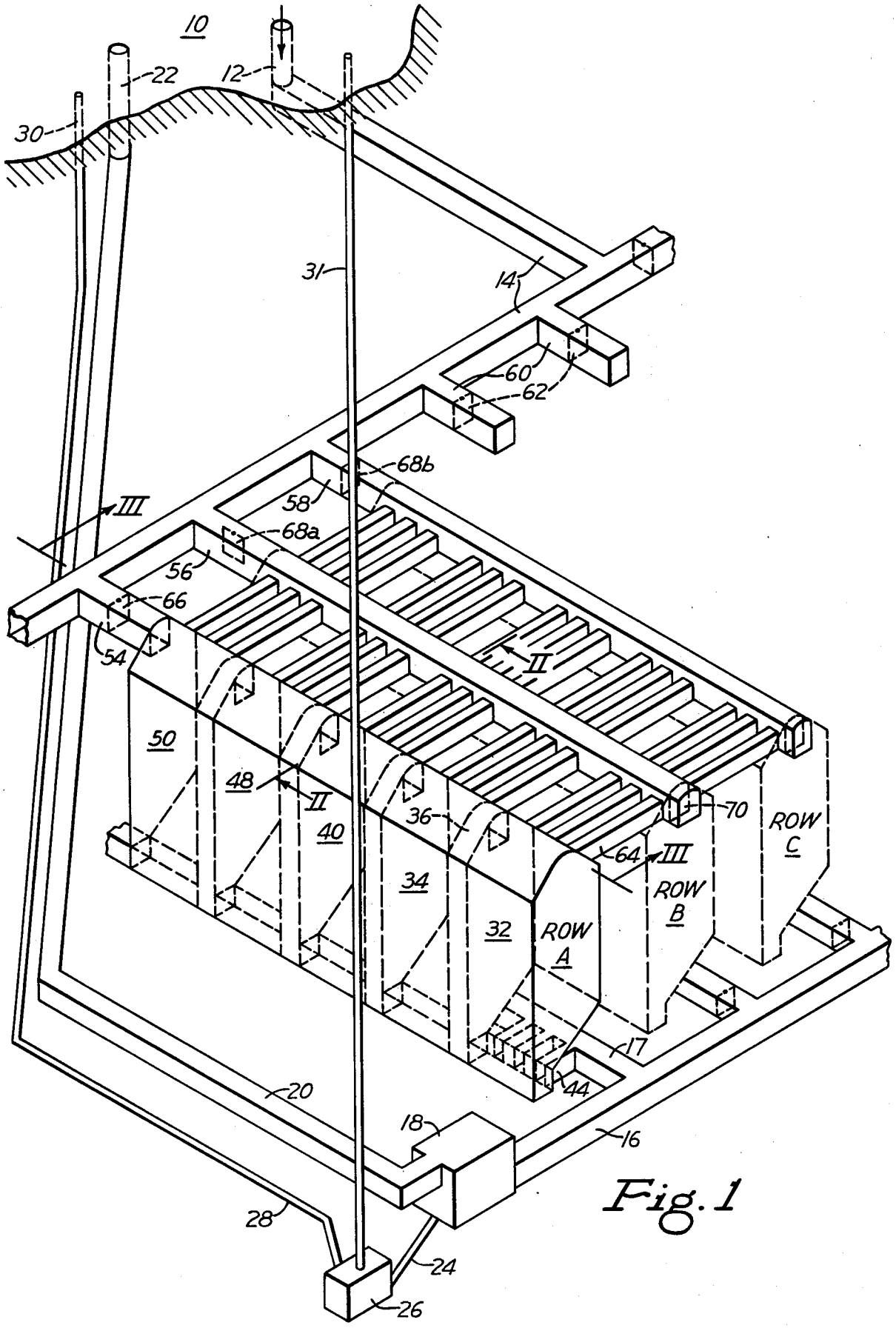
FIG. 1 is a perspective view of an array of in-situ retorts constructed in accordance with this invention.

Referring to FIG. 1, an array of in-situ retorts is shown arranged in parallel rows A, B and C in an oil shale deposit. The retorts are in shale strata located below the ground surface 10 at a depth selected to allow recovery of a maximum amount of shale oil from the shale deposits. The upper ends of the retorts should be in shale sufficiently rich in combustible carbonaceous materials to support combustion. The lower end of the retorts may be in oil shale or located in rock immediately below the oil shale deposits. The size of the retorts will depend on the characteristics of the shale deposit.

For example, each of the retorts may be 150 feet wide, 300 feet long and 750 feet high.

Figure 3:
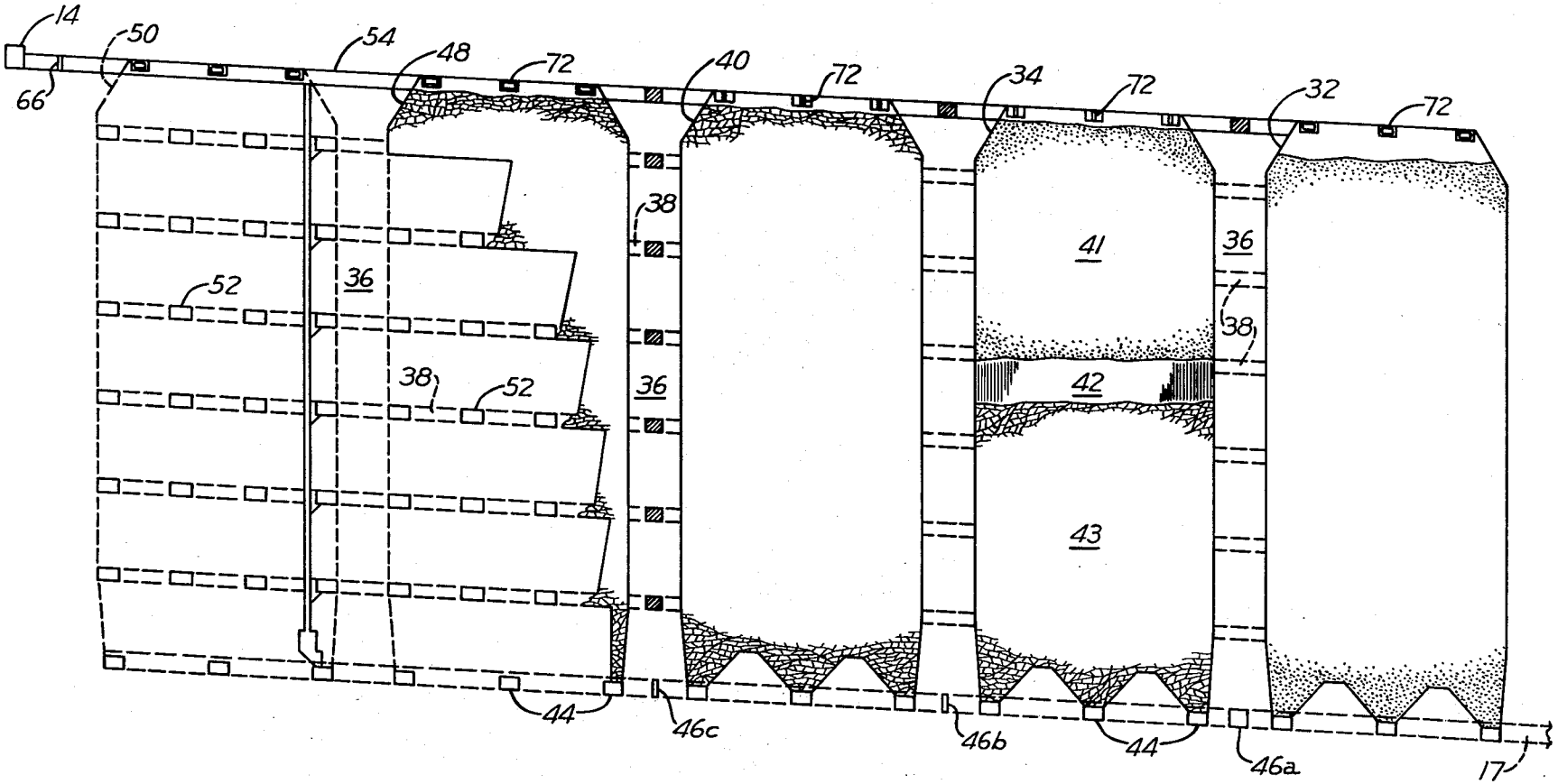
FIG. 3 is a longitudinal sectional view of a row of retorts taken along the section line III—III in FIG. 1.

Combustion air for the retorting operation is delivered from surface compression equipment, not shown, through a combustion air shaft 12 and air supply tunnel 14 to the upper ends of the retorts, as hereinafter described. Products and off gases produced during the retorting of the oil shale in the retorts in Row A are delivered through an exhaust tunnel 17 into a collection tunnel 16 and through the collection tunnel into a separator 18 for separation of gaseous products from aqueous liquid and shale oil. The gaseous products are delivered to the surface through an exhaust gas tunnel 20 and exhaust gas shaft 22 into processing equipment, not shown, located on the ground surface. The arrangement of the retorts in each row is substantially horizontal with a gradual slope of, for example, 3% to 10% downward toward the collection tunnel 16, as best illustrated in FIG. 3, to facilitate drainage of liquids to the collection tunnel. Liquid products from the separator are delivered through a duct 24 into a pumping station 26. The liquid products are delivered to the surface through pipes in a liquid products drift 28 separate from the exhaust gas tunnel and a liquid products shaft 30. In the embodiment of the invention illustrated in FIG. 1, a ventilation and access raise 31 extends from the pumping station 26 to the ground surface.

The retorts is row A are shown in FIG. 3 in different stages of preparation or operation than in FIG. 1. Retort 32 at the downdip or downstream end of row A farthest from air supply tunnel 14 has previously been retorted and is filled with spent shale. Retort 32 is separated from the adjacent retort 34 by an end pillar 36. A plurality of drifts indicated by reference numeral 38 extend through the end pillar 36 at different mining sub-levels during the preparation of the retort for retorting but are sealed by suitable barricades after rubblization and prior to burning oil shale in the adjacent retort.

Rubblized oil shale in retort 34 is in the process of being retorted by burning a portion of the carbonaceous material on the oil shale. The upper end of the retort contains spent shale zone 41. The spent shale is underlain by a burning zone 42 in which burning is proceeding to supply the heat necessary for retorting of the oil shale. Below the burning zone 42 is a retorting zone 43 in which rubblized oil shale is heated by hot gases from the burning zone to a temperature high enough to convert kerogen in the oil shale to shale oil. The shale oil drains downwardly through the retort and is delivered with the gaseous combustion products into exhaust tunnel 17 for delivery to the collection tunnel 16.

Up dip from the retort 34 in Row A is a rubblized but unburned retort 40. Drifts 38 through the end pillars 36 on both sides of rubblized retort 40 are suitably sealed such as by concrete barricades. The next retorts 48 and 50 in row A are in the process of rubblization and stoping for rubblization, respectively. While the rubblization can be accomplished by any method such as those described in the Van Poollen, Garrett or Uren patent, a preferred method is a sublevel caving method in which horizontal traverses of the retorts are made and oil shale is broken from substantially vertical faces to form a rubblized zone having 10 to 30 percent voids. At that stage, the retorts 48 and 50 contain mining drifts 52 which are useful in the preparation of the retort for rubblization and the subsequent rubblization but are filled with rubble during the rubblization. Each of the retorts is separated from the adjacent retorts in the row by an end pillar 36.

The exhaust tunnel 17 extends along the bottom of the retorts in row A for the full length of the row of retorts. Communication between the exhaust tunnel 17 and the outlet of each of the retorts is through cross drifts 44. Remote controlled doors **46*a*, 46*b*, and 46*c* are installed in exhaust tunnel 17 between the retorts to allow isolation of retorts in the stoping or rubblization stage from retorts that are completely rubblized or in the burning or retorting stage. Referring to FIG. 3, remote controlled doors 46*b* and 46*c*, which may be of the damper type, are shown in the closed position on both sides of retort 40. Door 46*a* between retort 32 and retort 34 is open to allow delivery of products from retort 34 through the exhaust tunnel 17 to the collection tunnel 16. A door has not yet been installed in exhaust tunnel 17 between retort 48 and retort 50, but will be after rubblization of retort 48** is completed. Alternatively, two movable doors can be installed and moved up dip after burning in a retort to locations that isolate a rubblized retort from an adjacent retort in which burning is in progress and from up-dip retorts in which stoping or rubblization is in progress.

Referring again to FIG 1, future retorts in row B and row C are shown in broken lines to indicate that they have not been completed at the stage of the development illustrated in FIG. 1. Extending from the combustion air tunnel 14 are parallel apex drifts 54 for retorts in row A, 56 for the future retorts in row B and 58 for the future retorts in row C. Each of the apex drifts 54, 56 and 58 extends from the combustion air supply tunnel 14 for a distance adequate to extend the full length of all of the retorts proposed in the respective row. Collars 60 closed by remote controlled doors 62 are drilled from combustion air tunnel 14 for future rows before initiating combustion in any of the retorts supplied with combustion air from tunnel 14.

Figure 2:
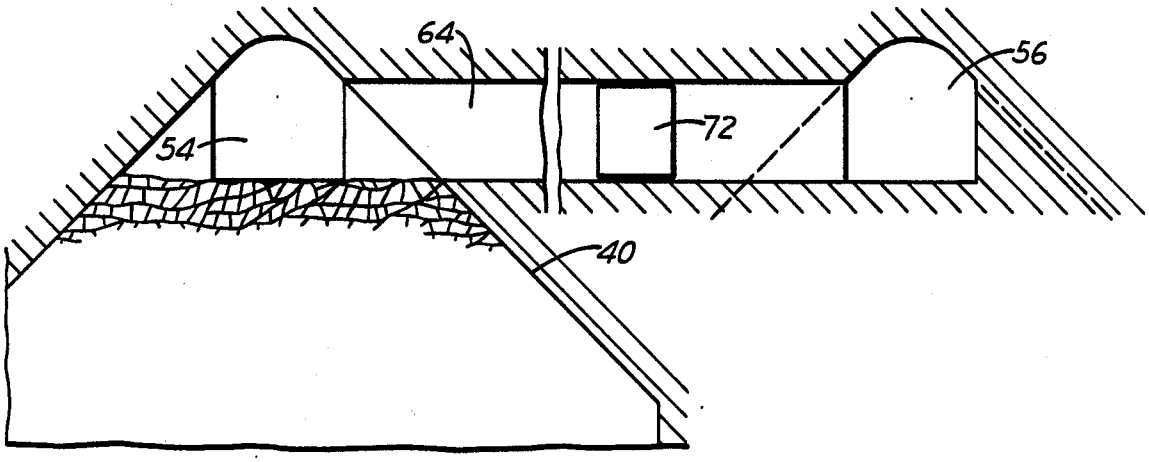
FIG. 2 is a transverse vertical sectional view along the section line II—II in FIG. 1 of the upper end of a rubblized retort.

The apex drifts 54, 56 and 58 are useful in the construction of retorts in the row and form the top of the retort after rubblization. By driving the apex drifts prior to the rubblization, the geometry of the crown of the retort can be controlled to provide a top of the retort of maximum stability. As is best shown in FIG. 2, the top of the apex drifts slopes upwardly from the sides at an angle of more than 40°, and preferably more than 45°, that is a continuation of the top of the retort when rubblization is completed. The peaks of the apex drifts are preferably rounded to minimize concentration of stresses. Upon completion of rubblization, the apex drifts are suitably barricaded in the end pillars 36 to isolate rubblized retorts from adjacent retorts. During the combustion or retorting phase, the apex drift serves as a manifold at the top of the retort for equalization of the distribution of combustion air to the top of the rubblized shale in the retort.

In FIG. 1, apex drift 54 is shown as extending to and communicating with the combustion air tunnel 14. Because in FIG. 1 row A includes the first retorts in the array in which combustion of oil shale will occur, apex drift 54 does not serve as a supply tunnel for combustion air; hence, it is not necessary that the apex drift extend beyond the retorts to combustion air tunnel 14. If apex drift 54 is extended to the combustion air tunnel during the work preliminary to the preparation of retorts in row A to facilitate mining and hauling operations, for example, apex drift 54 should be sealed, as indicated at 66, adjacent combustion air tunnel 14 before combustion air is delivered into the tunnel. Apex drifts 56 and 58, have doors 68a and 68b, respectively, similar to doors 62, adjacent the air supply tunnel to prevent flow of air into an apex drift when retorts in the row that includes the apex drift are retorted. Doors 68a and 68b are either in a fully open or fully closed position.

It is preferred that each of the apex drifts other than apex drift 54 have a remotely controlled movable door 70 mounted therein. Doors 70 will be positioned immediately downstream of the cross drifts 64 serving a retort in which burning is occuring. The door 70 may be of a type that is either fully opened or fully closed or may be merely a movable blockade that at all times prevents flow of combustion air into the apex drift downstream of the door. Upon completion of the burning in retort 32, door 70 will be moved to a location in apex drift 56 just upstream or up dip of the combustion air cross drifts serving retort 32. It is then possible to proceed with the preparation and rubblization of the retort in row B directly opposite retort 32 as well as retorts in row B downdip of such opposite retorts.

A plurality of combustion air cross drifts 64 extend from the apex drift 56 and open into the apex drift 54 in the upper end of each of the retorts in row A. Combustion air cross drifts for all retorts in row A are driven between apex drifts 54 and 56 before combustion is initiated in any of the retorts in row A. Similar air supply cross drifts 65 are driven between apex drift 58 and apex drift 56 before starting flow of combustion air through drift 56. Cross drifts 64 and 65 are small relative to the apex drifts. In a typical design for a reactor 150 feet wide and 300 feet long, three cross drifts 16 feet wide and 12 feet high may be provided for each reactor while the apex drifts may be 25 feet wide and 17 feet high.

Figure 4:
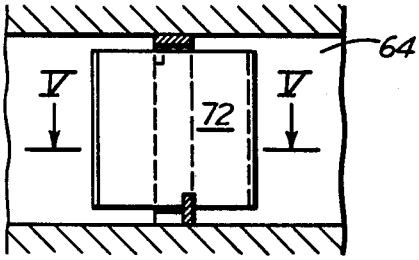
FIG. 4 is a schematic view in elevation of a door for controlling flow of air into a retort.
Figure 5:
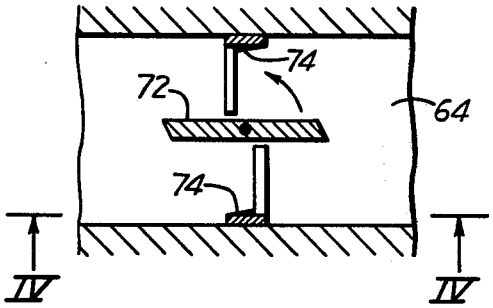
FIG. 5 is a horizontal sectional view taken along the section line V—V in FIG. 4.

Installed in each of the cross drifts 64 and 65 is a remote controlled control door 72 best illustrated diagrammatically in FIGS. 2, 4 and 5. Doors 72 can be of the damper type constructed to rotate about a vertical axis to adjust the flow of air through cross drifts 64 and thereby control the rate of combustion in a retort. After combustion in a retort is completed, the doors 72 in the cross drifts supplying the retort are rotated to a closed position engaging seats 74 to prevent the flow of air through the cross drifts 64.

In the production of oil by in-situ retorting of oil shale, retort 32 in row A, the retort down dip or most distant from combustion air tunnel 14, is the first retort rubblized. Apex drift 54 is sealed at 66 in the end pillar to prevent the flow of air into the apex drift and doors 46a and 46b are closed. Combustion air is delivered through shaft 12 and combustion air tunnel 14 into apex drift 56 and flows through that apex drift to cross drifts 64 communicating with retort 32. All other valves 72 in cross drifts communicating with apex drift 64 are closed. Oil shale is ignited in retort 32 by combustion of a suitable fuel which may be supplied through pipes, not shown, in cross drifts 64. After ignition of the oil shale, the supply of fuel is discontinued while the flow of air through cross drifts 64 is continued to burn oil shale in the retort. Products produced during the retort are delivered through exhaust tunnel 17 into collection tunnel 16 and then to the surface after separation of liquids and gases in separator 18. Flow of air through cross drifts 64 into retort 32 is continued until retorting in retort 32 is complete. The rate of flow of air through each of the cross drifts 64 to a retort is controlled by adjustment of valves 72 to maintain a desired downward rate of movement of the combustion front that moves uniformly along the length of retort.

After retorting is complete in retort 32, doors 72 in cross drifts 64 to that retort are closed and door 70 is moved to a position immediately upstream of the cross drifts 64 communicating with retort 32. The door 46a between retorts 32 and 34 is opened. At this time, rubblization of oil shale in retort 40 will have been completed. The door 46c between retort 40 and retort 48 is closed, doors 72 in the cross drifts serving retort 32 are opened, and combustion of oil shale begun in retort 34 to put the system in the condition illustrated in FIG. 3. In the embodiment of the invention illustrated in the drawings, each row includes only 5 retorts to simplify the illustration. It is contemplated that more than five retorts will be included in each row and combustion may proceed in more than one retort at one time.

The sequence of stoping, rubblization and burning progresses updip through each of the retorts in row A until all of the retorts in that row have passed through the burning or retorting stage. Retorts in row B will be successively stoped and rubblized downstream of the door 70, and by the time all retorts in row A have been retorted, retorts at the downdip end of row B will be in condition for the combustion stage. Collars for cross drifts to apex drift 60 will have been driven from apex drift 58 and doors similar to doors 72 installed in the collars. Door 68a in apex drift 54 is closed and door 68b is opened and air is supplied to retorts in row B through apex drift 58 for row C and cross drifts from the apex drift 58 to the apex drift 56. The updip retorts in row B are successively rubblized and retorted in series in the same manner as in row A. After completion of the retorting of the retorts in row B, the procedure is repeated in a similar fashion for retorts in row C and additional rows planned for the array until the entire array has been retorted.

By supplying combustion air to retorts through an apex drift that is displaced laterally from a row of retorts and is through rock that has not been damaged or weakened by the construction of retorts under the apex drift, the integrity of the drifts through which the air is supplied for combustion is assured. After use as a combustion air supply passage for retorting operations in an adjacent row, the apex drift is then useful in the construction of retorts that include the apex drift as the crown of retorts and facilitates the construction of retorts with minimum damage to the ceiling of the retort. After completion of rubblization of the retort, the apex drift then acts as a manifold to improve uniformity of distribution of combustion air in the retort during the burning phase of the oil recovery process.

The blocking of the combustion air flow in the apex drift adjacent the row of retorts in which combustion is proceeding to isolate that portion of such adjacent apex drift opposite retorts in which combustion has been completed allows stoping and rubblization to proceed in the downdip retorts under the apex drift through which the combustion air is supplied. Because of the high, relative to ventilation air, pressure to which the combustion air is compressed, the combustion air will be at a temperature above that at which mining operations can be conducted. The very large volume of combustion air required precludes cooling of the combustion air to temperatures at which men can work by dissipation of heat to the tunnel walls. Blocking of the adjacent apex drifts allows preparation of retorts in a second row during retorting in a first row so that there is no interruption of the retorting operation.

The apex drift through which combustion air is delivered to retorts below an adjacent apex drift is over undisturbed oil shale in that no retorts have been prepared below such drift. Danger of loss of the air supply to the retorts because of subsidence destroying air passages is virtually eliminated. Once a retort has been formed under an apex drift, that apex drift is no longer used as an air supply passage. The cross drifts being at the upper end of the pillar between rows of retorts where the pillars have their greatest width and the load on the pillars is least do not weaken the pillars seriously.

This invention is particularly advantageous for the recovery of shale oil from oil shale deposits by in-site combustion, but is not limited to use in the recovery of shale oil. Crude petroleum oil of high viscosity at normal reservoir temperatures can be recovered from reservoirs of low permeability by rubblizing rock in the reservoir to form an in-situ retort through which a combustion front can be passed to heat the rock in the reservoir to a temperature at which the oil will drain from the rock. This invention is useful in recovery of crude petroleum from such reservoirs. It also can be used in the in-situ gasification of coal to produce a combustible gas.

We claim:

1. A method of in-situ retorting carbonaceous deposits to produce a fluid fuel comprising driving a first apex drift, constructing a row of rubblized in-situ retorts below the first apex drift with the apex drift forming the crown of the retorts, said retorts being separated by end pillars, blockading the first apex drift in the end pillars to isolate each retort from adjacent retorts in the row, driving a second apex drift parallel to and laterally displaced from the first apex drift, said second apex drift having an upstream end and communicating with a combustion air supply tunnel at its upstream end, driving combustion air cross drifts from the second apex drift to communicate with the first apex drift in each of the retorts in the row, igniting the carbonaceous deposits in the retorts, supplying combustion air through the second apex drift and the combustion air cross drifts to burn carbonaceous deposits in the retorts to release fluid fuel in said retorts, delivering the released fluid fuel to the surface, constructing retorts under the second apex drift following the burning of carbonaceous deposits in the row of retorts under the first apex drift, supplying combustion air to the retorts under the second apex drift from a third apex drift substantially parallel to and laterally displaced from the second apex drift, and repeating the sequence of supplying air through apex drifts and then constructing retorts under the apex drifts.

2. A method as set forth in claim 1 characterized by the carbonaceous deposit being oil shale and burning oil shale in the downstream retort in the row first and proceeding with the burning of oil shale in series from the downstream retort to the upstream retort in the row, following burning of oil shale in a specific retort blocking the flow of combustion air in the adjacent apex drift immediately upstream of the cross drifts supplying air to the specific retort, and following the blocking of the flow of combustion air in the adjacent apex drift, preparing, rubblizing and burning retorts below the portion of the adjacent drift into which the flow of combustion air has been blocked.

3. In a system for the in-situ retorting of a carbonaceous deposit in which a combustion air supply tunnel extends through an underground carbonaceous deposit and a plurality of spaced-apart parallel apex drifts communicate with and extend from the combustion air tunnel, the improvement comprising successively supplying combustion air through each apex drift to an adjacent row of retorts for combustion of carbonaceous material in said retorts and thereafter constructing a row of retorts under the apex drift with the apex forming the crown of the retorts whereby the apex drifts serve first as a passage for delivering combustion air to an adjacent row of retorts and then as a combustion air equalization passage in retorts therebelow.

4. In a process for the in-situ retorting of oil shale in subsurface oil shale deposits in which the retorting sequentially progresses away from a first boundary in the oil shale deposit to a remote second boundary, the improvement comprising constructing a combustion air tunnel in the oil shale deposit extending in the direction of progress of the retorting, driving a plurality of spaced apart apex drifts communicating with the combustion air tunnel, the sequence of blocking flow from the combustion air tunnel into the apex drift nearest the first boundary constructing a row of rubblized in-situ retorts under the apex drift nearest the first boundary, supplying air for combustion of oil shale in retorts below the apex drift nearest the first boundary from the adjacent apex drift spaced from the retorts in the direction of progressing of the retorting burning oil shale in the retorts to release shale oil, delivering shale oil to the surface.

5. A process as set forth in claim 4 characterized by following burning in the retorts with the sequence of blocking flow of combustion air in said adjacent apex drift, construction of retorts below said adjacent apex drift, supplying air to the retorts below said adjacent apex drift through the next apex drift in the direction of progress of the retorting, burning oil shale in such retorts to release shale oil from the shale and delivering shale oil to the surface; and repeating the cycle of supplying air followed by the sequence in each of the apex drifts successively in the direction of progression toward the remote boundary, whereby each of the apex drifts serves first to supply air to retorts under an adjacent apex drift serving as the crown of the retorts and then as the crown of retorts.

6. A system for the production of shale oil from a subsurface deposit of a carbonaceous material comprising a combustion air tunnel extending substantially horizontally through the subsurface deposit, a plurality of spaced-apart parallel apex drifts extending from the air supply tunnel, a row of retorts separated by end pillars extending downwardly from an apex drift, the apex drift forming the crown of the retorts in the row, the apex drift adjacent to the row of retorts being over undisturbed carbonaceous deposit, cross drifts extending from the adjacent apex drift opposite each retort in the row to communicate with the apex drift forming the crown of each retort, means for delivering air for combustion of carbonaceous material in the retorts through the adjacent apex drift and cross drifts into the retorts, an adjustable door in the cross drifts for controlling the flow of combustion air through the cross drifts and for closing the cross drift after combustion in the retort supplied by the cross drift is completed.

7. A system as set forth in claim 6 characterized by a door movable in the adjacent apex drift to isolate the portion of the adjacent apex drift downdip of the door from the combustion air tunnel.

8. A system as set forth in claim 6 characterized by a remote controlled door in the adjacent apex drift adjacent to the combustion air tunnel adapted to close to prevent flow into the adjacent apex drift after shale in all of the retorts in the row has been retorted.

9. A system as set forth in claim 6 in which there are a plurality of parallel rows of retorts, the spacing of the adjacent apex drift from the row of retorts supplied with combustion air is substantially equal to the spacing between the rows of retorts, the retorts in each row include an apex drift at their upper ends.

10. A system as set forth in claim 6 in which the ceiling of the retorts slopes upwardly from the sidewalls of the retort, the apex drifts have vertical sidewalls extending upwardly from a footwall, and a ceiling sloping upwardly at the same angle as the ceiling of the retorts whereby the ceiling of the apex drifts is a continuation of the ceiling of the retorts.

11. A method as set forth in claim 1 characterized by the carbonaceous deposit being oil shale.

12. A method as set forth in claim 1 characterized by the carbonaceous deposit being a petroleum crude oil reservoir.

13. A method as set forth in claim 1 characterized by the carbonaceous deposit being coal.

14. A system as set forth in claim 4 characterized by the carbonaceous deposit being oil shale.

15. A system as set forth in claim 4 characterized by the carbonaceous deposit being a petroleum reservoir of heavy, highly viscous oil.

16. A system as set forth in claim 4 characterized by the carbonaceous deposit being coal.

17. A system as set forth in claim 6 characterized by the deposit of carbonaceous material being oil shale.

18. A system as set forth in claim 6 characterized by the deposit of carbonaceous material being a petroleum reservoir.

19. A system as set forth in claim 6 characterized by the deposit of carbonaceous material being coal.

* * * * *